US005827442A

United States Patent [19]

Wicker et al.

[11] Patent Number: 5,827,442

[45] Date of Patent: Oct. 27, 1998

[54] FORM GAP FILLING DEVICE

[76] Inventors: Keith E. Wicker, 11001 Needles Ct., Parker, Colo. 80134; William G. Schmidt, 12895 E. Nevada Cir., Aurora, Colo. 80012

[21] Appl. No.: 673,595

[22] Filed: Jul. 1, 1996

[51] Int. Cl.[6] ..... E04G 11/06

[52] U.S. Cl. ..... 249/193; 249/18; 249/47; 249/188

[58] Field of Search ..... 249/18, 33, 47, 249/157, 188, 189, 193, 210; 52/463, 464, 468, 584.1

[56] References Cited

U.S. PATENT DOCUMENTS

| | | | |
|---|---|---|---|
| 1,211,901 | 1/1917 | Wales | 249/193 |
| 1,312,462 | 8/1919 | Wales | 249/193 |
| 1,354,705 | 10/1920 | Wales | 249/193 |
| 2,055,977 | 9/1936 | Hayes | 249/34 |
| 2,209,580 | 7/1940 | Sargent | 52/584.1 |
| 2,280,094 | 4/1942 | Madsen | 52/464 |
| 2,537,216 | 1/1951 | Faix | 52/463 |
| 2,969,549 | 1/1961 | Mills | 52/468 |
| 3,244,395 | 4/1966 | Arrighini | 249/193 |
| 3,552,704 | 1/1971 | Pond | 52/464 |
| 3,760,544 | 9/1973 | Hawes et al. | 52/468 |
| 3,994,471 | 11/1976 | Turolla | 249/205 |
| 4,059,933 | 11/1977 | Funk et al. | 52/464 |
| 4,067,155 | 1/1978 | Ruff et al. | 52/105 |
| 5,365,713 | 11/1994 | Nicholas et al. | 52/573.1 |
| 5,400,559 | 3/1995 | Nicholas | 52/396.05 |

*Primary Examiner*—James P. Mackey
*Attorney, Agent, or Firm*—Michael A. Capraro

[57] ABSTRACT

A form gap filling device for filling or blocking form gaps in construction forms used to fabricate foundations, walls and similar structures. The form gap filling device is comprised of an elongated member having an elongated support centrally and longitudinally formed thereon, angled main portions formed on the elongated support and extending outward from the elongated support, angled sealing portions formed on the main portions and extending outward from the main portions and at least one spring biased rotatable handle rotatably attached to the elongated member. The at least one spring biased rotatable handle is medially positioned on and removably contacts a support surface of the elongated support. The at least one spring biased rotatable handle acts in concert with the sealing portions to removably engage adjacent spaced apart form elements thereby filling or blocking construction form gaps.

18 Claims, 6 Drawing Sheets

FORM GAP FILLING DEVICE

This invention relates generally to devices utilized to fill or block gaps that may occur in congealable material forms or molds and more specifically to a new and novel form gap filling device and method. The new and novel form gap filling device and method is designed to quickly and easily fill or block a gap in a congealable material form while producing a relatively smooth finished surface.

While there are a wide variety of devices that are utilized to cover gaps left in architectural joints, these devices are applied to existing joint gaps left in congealed structures as part of the architectural design and are not practical for use in the construction of building foundations, walls and other similar structures that are fabricated from a congealable material such as concrete. Building foundations, walls and other similar structures are fabricated from a congealable material, such as concrete, by constructing a form or mold that can contain the congealable material and allow it to congeal, harden, set or cure. The form structure is then removed from the congealed material resulting in a finished foundation, wall or similar structure. Forms are typical produced by arranging a series of form elements in dimensions suited for the particular building foundation, wall or similar structure being fabricated. These form elements are made of standard form material, usually panels or sheets of plywood, press board or similar material, and generally have a standard height and width. The form elements are arranged so that appropriate edges, usually long edges, of each form element abut one another to create a continuous form run. Building specifications often require the foundation wall or similar structure to be of a length that is not equally divisible by standard form element dimensions. Thus, the resulting form run will have a space or gap between two of the adjacent form elements that must be filled or blocked so that the form can contain the congealable material used to produce the finished foundation, wall or similar structure.

Various attempts have been made to fill or block these gaps, the typical procedure being to simply cover the gap with another piece of a form element, usually in the form of a piece of wood, by nailing or otherwise securing the form element piece to spaced apart form elements adjacent to and on either side of the gap. Since form elements are typically one-half to one inch thick, this results in a space or cavity between an inner surface of the form elements and an inner surface of the form element piece used to cover the gap, the space or cavity having the same width as the gap. When congealable material is poured into a form where the gap has been filled or blocked in this manner, the congealable material fills the space or cavity left by the gap and the outer form piece covering the gap. When the congealable material has hardened, set or cured, and the form elements are removed, an area of congealed material equal to the area of the space or cavity protrudes from the surface of the finished foundation, wall or similar structure.

These protrusions interfere with the final finishing of the foundation, wall or similar structure. For example, if drywall or plasterboard is to be attached or secured to the foundation, wall or similar structure, the congealed protrusion must either be removed or the drywall or plasterboard must be manipulated around the protrusion still leaving an unsightly and unwanted protrusion on the final finished surface. Additionally, the protrusion may have to be removed to allow the placement of electrical, water, gas and other conduits or equipment on the foundation, wall or similar structure. Removal of these protrusions is an expensive and hazardous process and often results in damage to other areas of the finished wall.

SUMMARY OF THE INVENTION

To overcome the before described considerations and problems inherent in and encountered with prior art form gap filling devices, there is provided by the subject invention a unique form gap filling device and method that effectively fills or blocks a form gap to produce a relatively smooth finished foundation, wall or similar structure surface. The new and novel form gap filling device is also designed to be quickly and easily positioned on and removed from form elements. Additionally, the new and novel form gap filling device is further designed to be re-used in the subsequent fabrication of other building foundations, walls or similar structures.

The new and novel form gap filling device is constructed with an elongated member having a first side, second side and opposing ends. Elongated support means, having a support surface, is centrally and longitudinally formed on the first side of the elongated member, the elongated support means being of equal length as the elongated member. Main portions are formed on the elongated support means opposite the support surface, the main portions extending the length of the elongated member and also extending outward from the elongated support means and angled toward the support surface of the elongated support means. Sealing portions are formed on the main portions, the sealing portions also extending the length of the elongated member and extending outward from the main portions and angled toward the support surface of the elongated support means, the sealing portions having rounded edges formed thereon.

At least one spring biased rotatable engaging means is centrally and rotatably attached to the first side of the elongated member, the at least one engaging means being centrally and rotatably attached equidistant from the ends of the elongated member. In the Preferred Embodiment, the at least one spring biased rotatable engaging means is a spring biased rotatable handle, the at least one engaging means being medially positioned on the elongated support means and centrally positioned on the elongated member. In another embodiment, two at least one spring biased rotatable engaging means are rotatably attached to the elongated member, the two at least one engaging means being medially positioned on the elongated support means surface, one of the at least one engaging means being positioned equidistant between an end and the center of the elongated member and another of the at least one engaging means being positioned equidistant between an opposite end and the center of the elongated member. Further, in another embodiment, three at least one spring biased rotatable engaging means are rotatably attached to the elongated member, the three at least one engaging means being medially positioned on the elongated support means surface, a first at least one engaging means being positioned equidistant between an end and an opposite end of the elongated member, a second at least one engaging means being positioned equidistant between an end and the center of the elongated member and a third at least one engaging means being positioned equidistant between an opposite end and the center of the elongated member.

The at least one spring biased rotatable engaging means has an upstanding main body formed on an engaging member, the engaging member having an engaging surface formed opposite the upstanding main body. The upstanding main body and the engaging member are reinforced by support members, the support members joining ends of the engaging member with an upper portion of the upstanding main body. A spring means is contained within the upstanding main body of the at least one spring biased rotatable engaging means and encompasses an anchor means. The anchor means has a threaded end portion and is disposed through the spring means, the threaded end portion being further disposed through an opening in the engaging surface of the engaging member. The threaded end portion of the anchor means is engaged by an attaching means receptacle disposed through the elongated member and through the elongated support means thereby rotatably attaching the at least one engaging means to the elongated member. A cap formed on the attaching means limits the disposition of the attaching means through the elongated member and allows the attaching means to lie flush with the surface of the second side of the elongated member.

The new and novel form gap filling device is positioned on adjacent spaced apart form elements by placing the rounded edges of the sealing portions against an inner surface of the adjacent spaced apart form elements on either side of the form gap. The at least one spring biased rotatable engaging means is then pulled outward and rotated so that portions of the engaging surface of the engaging member are positioned over an outer surface of the adjacent spaced apart form elements. The spring means urges the engaging member, and thus the engaging surface, toward the outer surface of the adjacent spaced apart form elements and causes the engaging surface to contact the outer surface of the adjacent spaced apart form elements when the at least one spring biased rotatable engaging means is released. The spring means simultaneously pulls the rounded edges of the sealing portions against the inner surface of the adjacent spaced apart form elements, the form gap filling device thereby engaging the adjacent spaced apart form elements and filling or blocking the form gap.

Congealable material can then be poured into the form and allowed to congeal, harden, set or cure. The weight of the congealable material flattens the angled main portions and the angled sealing portions of the elongated member, allowing the sealing portions to fully contact the inner surface of the adjacent spaced apart form elements, thereby creating an effective seal that prevents loss of congealable material from the form gap. Once the congealable material has congealed, the form elements, along with the form gap filling device, are removed from the finished foundation, wall or similar structure.

In the Preferred Embodiment, the at least one spring biased rotatable engaging means of the new and novel form gap filling device is constructed from a rigid, non-flexing material such as steel, aluminum, brass and other metal alloys. Also in the Preferred Embodiment, the elongated member is constructed from a semi-rigid, resilient material, such as aluminum and the main portions and the sealing portions have an inherent memory, thereby retaining their original shape and angled configuration after having been subjected to the flattening forces of a congealable material. Thus, the form gap filling device can be re-used on other form elements to fill or block form gaps. The main portions and the sealing portions of the elongated member are further designed to be relatively thin so that only a slight indentation is left in the surface of a finished foundation, wall or similar structure, eliminating congealed protrusions.

To achieve the foregoing and other advantages, the present invention provides a new and novel form gap filling device that is quickly and easily positioned on and removed from form elements, effectively fills or blocks a form gap, produces a relatively smooth finished foundation, wall or similar structure surface, and can be re-used in the subsequent fabrication of other building foundations, walls or similar structures.

The more important features of the present invention have been broadly outlined in order that the detailed description thereof that follows may be better understood and in order that the present contribution to the art may be better appreciated. There are additional features of the invention that will be more fully described hereinafter and which, together with the features outlined above, will form the subject matter of the claims appended hereto. Those skilled in the art will appreciate that the conception, upon which the present disclosure is based, may readily be utilized as a basis for the designing of other structures, methods and systems for carrying out the several purposes of the present invention. It is important, therefore, that the claims be regarded as including such equivalent construction insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory review the nature and essence of the technical disclosure of the application. The abstract is neither intended to define the invention of the application, which is measured by the claims, nor is it intended to be limiting as to the scope of the invention in any way.

Accordingly, it is an object and advantage of the invention to provide a new and novel form gap filling device that is quickly and easily positioned on and removed from form elements.

Another object and advantage of the invention is to provide a new and novel form gap filling device that effectively fills or blocks form gaps.

Another object and advantage of the invention is to provide a new and novel form gap filling device that effectively seals a form gap and retains congealable material used to form a foundation, wall or similar structure within a form or mold.

Another object and advantage of the invention is to provide a new and novel form gap filling device that produces a relatively smooth finished foundation, wall or similar structure surface.

Another object and advantage of the invention is to provide a new and novel form gap filling device that retains its original shape and configuration and is reusable.

Still another object and advantage of the invention is to provide a new and novel form gap filling device which may be easily and efficiently manufactured and marketed.

Yet another object and advantage of the invention is to provide a new and novel form gap filling device which is of durable and reliable construction.

These and other objects and advantages will become apparent from review of the drawings and from a study of the Description of the Preferred Embodiment relating to the drawings which has been provided by way of illustration only.

DESCRIPTION OF THE PREFERRED EMBODIMENT

Figure 1:
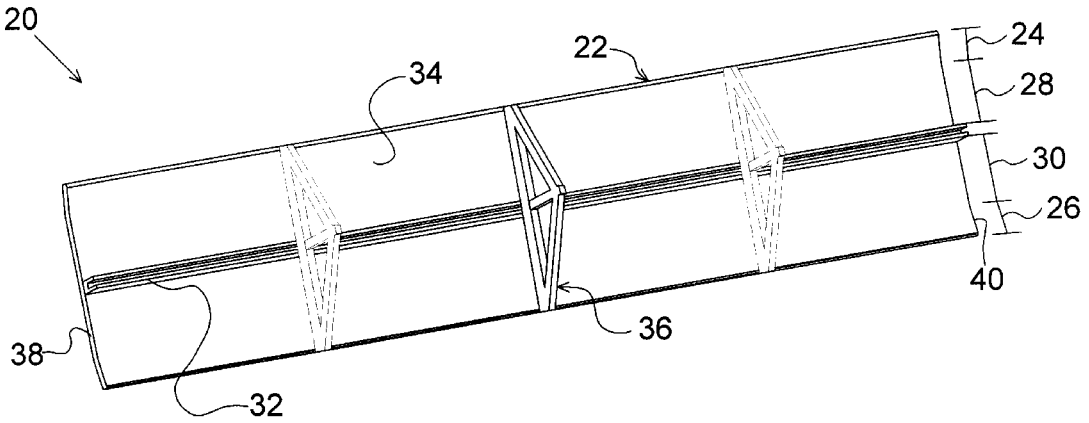
FIG. 1 is a perspective view of the new and novel form gap filling device.

Referring to the drawings in general, the present description is given in the context of the new and novel form gap filling device as utilized in the construction or fabrication of a concrete building foundation. It will be readily apparent to those skilled in the art that the usefulness of the present invention is not limited to this application and that changes could be made in construction and should be considered to be within the spirit and scope of the present invention.

Referring now in particular to FIG. 1 of the drawings, there is shown the new and novel form gap filling device, shown generally by the numeral 20. The new and novel form gap filling device 20 has been designed to be utilized with prior art forms or molds of various types when constructing or fabricating building foundations, walls and other similar structures from congealable material, such as concrete and other similar material. FIG. 1 of the drawings is a perspective view of the new and novel form gap filling device 20.

An elongated member, shown generally by the numeral 22, has sealing portions 24 and 26 continuously formed on main portions 28 and 30 of the elongated member 22, sealing portion 24 being formed on main portion 28 and sealing portion 26 being formed on main portion 30. Elongated support means 32 is longitudinally and medially formed on first side 34, the elongated support means 32 being of equal length as the elongated member 22. At least one spring biased rotatable engaging means, shown generally by the numeral 36, is centrally and rotatably attached to the elongated member 22, the at least one engaging means 36 being rotatably attached equidistant from end 38 and opposite end 40 of the elongated member 22.

In the Preferred Embodiment, the at least one spring biased rotatable engaging means 36 is a spring biased rotatable handle and is centrally and rotatably attached to the elongated member 22, the at least one engaging means 36 being medially positioned on elongated support means 32 and centrally positioned on the elongated member 22. In another embodiment, two at least one spring biased rotatable engaging means 36 are rotatably attached to the elongated member 22, the two at least one engaging means 36 being medially positioned on elongated support means 32, one of the at least one engaging means 36 being positioned equidistant between end 38 and the center of the elongated member 22 and another of the at least one engaging means 36 being positioned equidistant between opposite end 40 and the center of the elongated member 22. One of the at least one engaging means 36 and another of the at least one engaging means 36 are shown in dashed lines in FIG. 1 of the drawings for purposes of clarity. Further, in another embodiment, three at least one spring biased rotatable engaging means 36 are rotatably attached to the elongated member 22, the three at least one engaging means 36 being medially positioned on elongated support means 32, a first at least one engaging means 36 being positioned equidistant between end 38 and opposite end 40 of the elongated member 22, a second at least one engaging means 36 being positioned equidistant between end 38 and the center of the elongated member 22 and a third of the at least one engaging means 36 being positioned equidistant between opposite end 40 and the center of the elongated member 22. Two of the three at least one engaging means 36 are shown in dashed lines in FIG. 1 of the drawings for purposes of clarity. The present description and the drawings in general are given in the context of the new and novel form gap filling device 20 having at least one spring biased rotatable engaging means 36. It will be readily apparent to those skilled in the art that the present invention is not limited to a single at least one spring biased rotatable engaging means 36 and that other numbers and combinations of spring biased rotatable engaging means could be used and should be considered to be within the spirit and scope of the present invention.

Figure 2:
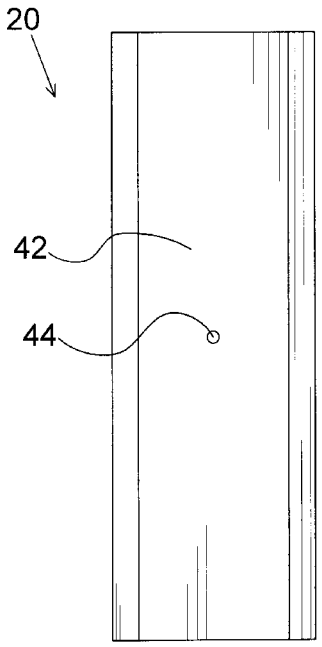
FIG. 2 is a rear plan view of the new and novel form gap filling device.

Referring now to FIG. 2 of the drawings there is shown a rear plan view of the form gap filling device 20. Second side 42 has a smooth surface designed to easily and freely release from congealed material. Removal of the form gap filling device 20, and thus of the second side 42 of the elongated member 22, from congealed material will be discussed more fully hereinafter. Attaching means 44 is centrally and medially disposed through elongated member 22 and through elongated support means 32, the attaching means 44 rotatably attaching the at least one engaging means 36 to the elongated member 22. Elongated support means 32 and the at least one engaging means 36 cannot be seen in FIG. 2 of the drawings but are clearly seen in FIGS. 1, 3–5 and 8–12 of the drawings. The attaching means 44 will be discussed more fully hereinafter.

Figure 3:
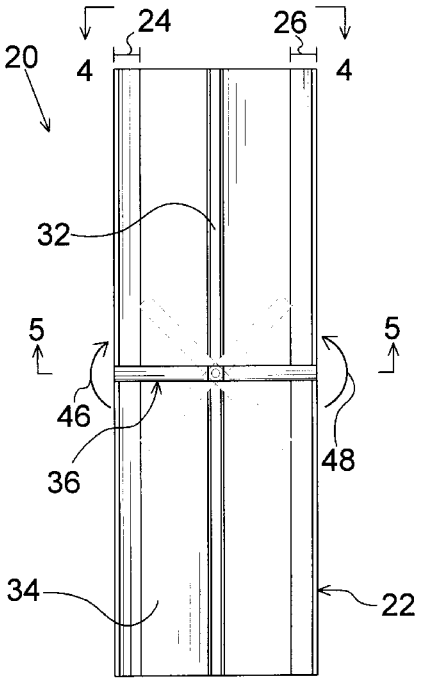
FIG. 3 is a front plan view of the new and novel form gap filling device.

Referring now to FIG. 3 of the drawings there is shown a front plan view of the new and novel form gap filling device 20. Elongated support means 32 is longitudinally and medially formed on first side 34 of the elongated member 22 and is of equal length as the elongated member 22. At least one engaging means 36 is rotatably attached to the elongated member 22 and removably and rotatably contacts elongated support means 32. The at least one engaging means 36 is rotatable in the direction of arrows 46 and 48, alternate positions being shown in dot-dash lines for purposes of clarity. The at least one engaging means 36 may be rotated to any number of alternate positions and is not limited to those alternate positions shown in FIG. 3 of the drawings which are provided for purposes of illustration only. The elongated support means 32 and the rotatable attachment of the at least one engaging means 36 to the elongated member 22 will be discussed more fully hereinafter.

Figure 4:
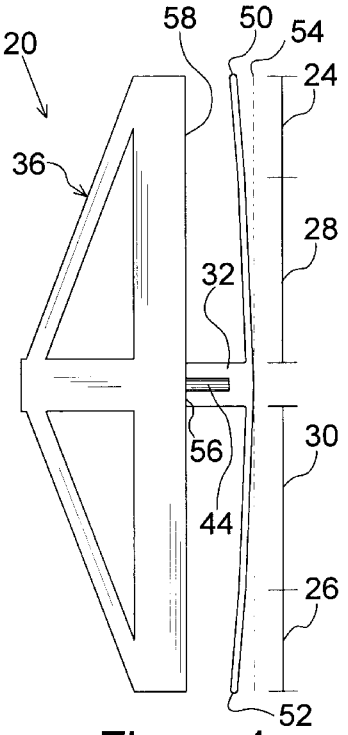
FIG. 4 is an end view of the new and novel form gap filling device taken along lines 4—4 of FIG. 3 of the drawings.
Figure 5:
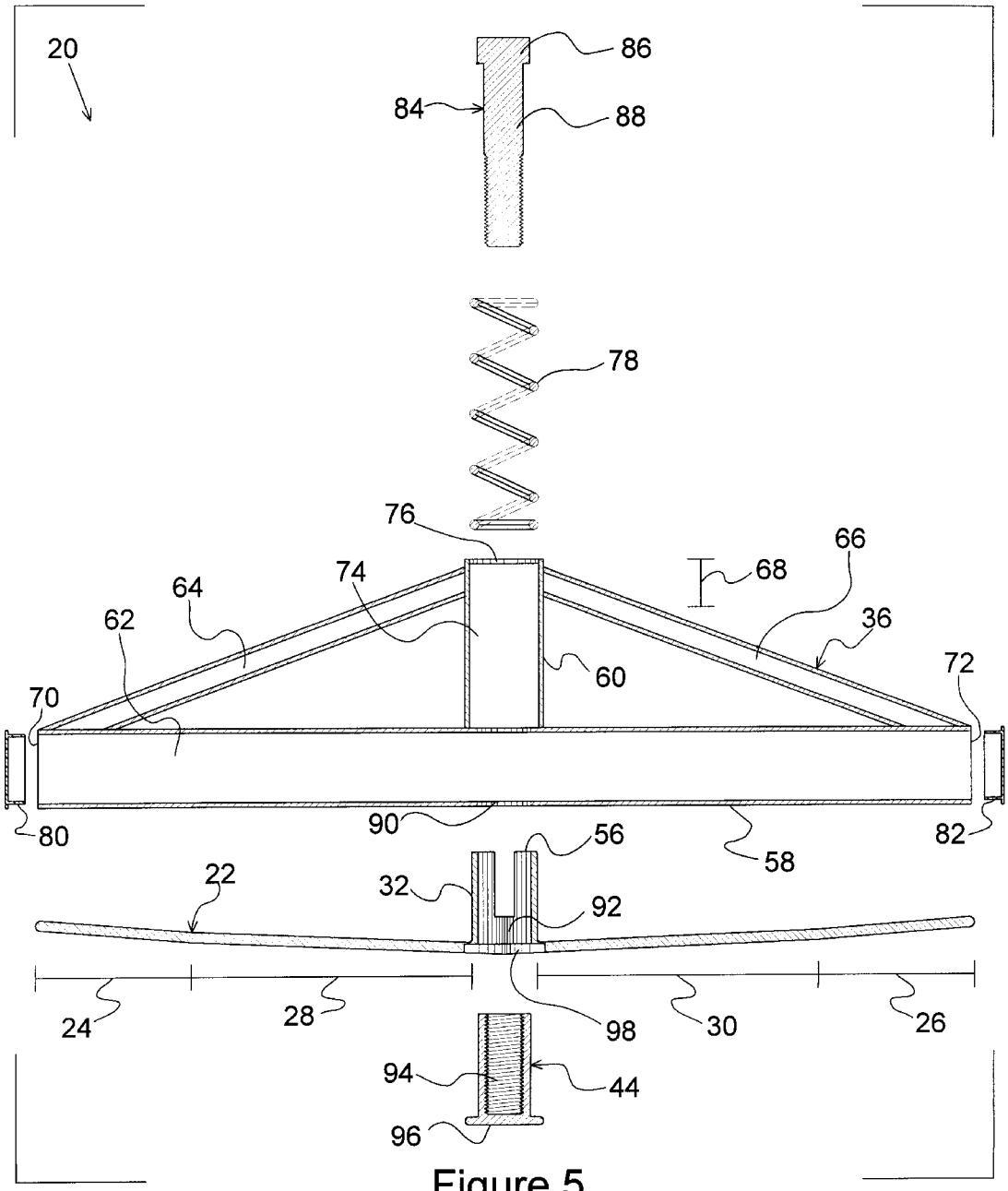
FIG. 5 is an exploded cross-sectional view of the form gap filling device taken along lines 5—5 of FIG. 3 of the drawings.

Referring now in general to FIGS. 4 and 5 of the drawings there will be shown and described in detail the new and novel form gap filling device 20. Referring now in particular to FIG. 4 of the drawings, there is shown an end view of the new and novel form gap filling device 20 taken along lines 4—4 of FIG. 3 of the drawings. FIG. 4 illustrates the angled nature of the elongated member 22. Main portions 28 and 30 of elongated member 22 are angled upwardly and away from a longitudinal axis of elongated support means 32. Sealing portions 24 and 26 are angled upwardly and away from the plane of main portions 28 and 30, sealing portion 24 having rounded edge 50 formed thereon and sealing portion 26 having rounded edge 52 formed thereon.

In the Preferred Embodiment, main portions 28 and 30 have been designed to be angled 1 to 10 degrees from a plane 54 and toward support surface 56 of the elongated support means 32, the plane 54 being perpendicular to an axis of symmetry of the form gap filling device 20, the plane 54 being indicated by a dot-dash line in FIG. 4 of the drawings, an angle of approximately 2.5 degrees being preferred. The sealing portions 24 and 26 have also been designed to be angled 1 to 10 degrees from plane 54 and toward support surface 56, the plane 54 being perpendicular to an axis of symmetry of the form gap filling device 20, the plane 54 being indicated by a dot-dash line in FIG. 4 of the drawings, an angle of approximately 5 degrees being preferred. Described another way, main portions 28 and 30 extend oppositely outward from elongated support means 32 and are angled 1 to 10 degrees toward the at least one engaging means 36, an angle of approximately 2.5 degrees being preferred, and the sealing portions 24 and 26 extend oppositely outward from the main portions 28 and 30 respectively, and are angled 1 to 10 degrees toward the at least one engaging means 36, an angle of 5 degrees being preferred. Other configurations and angles known in the art may also be used and are considered to be within the spirit and scope of the present invention.

Still referring to FIG. 4 of the drawings, sealing portions 24 and 26, main portions 28 and 30 and elongated support means 32, in toto, make up elongated member 22. In the Preferred Embodiment and in FIG. 4 of the drawings, elongated support means 32 is a channel having a general U-shape configuration and is continuously formed with main portions 28 and 30 of the elongated member 22. Elongated support means 32 could also be a solid member continuously formed with or fixedly attached to main portions 28 and 30. Other configurations and methods of attachment known in the art may also be used and are considered to be within the spirit and scope of the present invention.

Attaching means 44 rotatably anchors at least one spring biased rotatable engaging means 36 to elongated member 22. Only a portion of attaching means 44 is visible in FIG. 4 of the drawings, the entire attaching means 44 being clearly shown in FIG. 5 of the drawings. Still referring to FIG. 4 of the drawings, the at least one spring biased rotatable engaging means 36 is shown in a non-tensional state, a portion of engaging surface 58 of the at least one engaging means 36 being in contact with support surface 56 of the elongated support means 32, the support surface 56 being opposite the junction of the elongated support means 32 and the main portions 28 and 30.

Referring now to FIG. 5 of the drawings there is shown an exploded cross-sectional view of the form gap filling device taken along lines 5—5 of FIG. 3 of the drawings. The at least one engaging means 36 has an upstanding main body 60 centrally formed on and perpendicular to engaging member 62. Engaging surface 58 is formed on engaging member 62 opposite the junction of upstanding main body 60 and engaging member 62. Support members 64 and 66 join upper portion 68 of upstanding main body 60 with ends 70 and 72 of the engaging member 62. A cavity or bore 74 is centrally and longitudinally formed through the main body 60. An upper opening 76 allows spring means 78 to be disposed into the upstanding main body 60. Portions of the spring means 78 not visible in the cross-sectional view are shown in dashed lines for purposes of clarity.

In the Preferred Embodiment, upstanding main body 60, engaging member 62 and support members 64 and 66 are constructed from rigid, non flexing material such as steel, aluminum, brass and other metal alloys, the upstanding main body 60 being joined to the engaging member 62 and the support members 64 and 66 being joined to the upstanding main body 60 and to the ends 70 and 72, respectively, of the engaging member 62 by welding, brazing, high temperature fusion, or other metal joining methods. Other rigid, non-flexing materials, such as other metal alloys and rigid non-flexing plastic polymers, and other methods of joining known in the art may also be used and are considered to be within the spirit and scope of the present invention.

End caps 80 and 82 may be inserted into the ends 70 and 72 respectively, of the engaging member 62. In the Preferred Embodiment, the ends caps 80 and 82 are constructed from plastic, rubber, nylon or similar material and provide smooth, finished, non-gouging ends on the engaging member 62 of the at least one engaging means 36. Other materials known in the art may also be used and are considered to be within the spirit and scope of the present invention.

Anchor means, shown generally by the numeral 84, having retaining means 86 and shaft 88, an end portion of the shaft 88 opposite the retaining means 86 being threaded, is partially disposed through spring means 78 so that shaft 88 is movably encompassed by spring means 78. Retaining means 86 limits the disposition of anchor means 84 through spring means 78. A lower opening 90 is formed in engaging surface 58, the lower opening 90 being smaller than spring means 78 but larger than anchor means 84. Thus, lower opening 90 allows the threaded portion of shaft 88 of anchor means 84 to exit the upstanding main body 60 from the engaging surface 58 of the engaging member 62 while preventing the spring means 78 from exiting the upstanding main body 60 from the engaging surface 58. Thus, spring means 78 is contained within the upstanding main body 60 between the retaining means 86 of the anchor means 84 and the engaging surface 58 of the engaging member 62. In the Preferred Embodiment and in FIG. 5 of the drawings, spring means 78 is a coil spring. Other types of springs known in the art may also be used and are considered to be within the spirit and scope of the present invention.

A bore 92 is centrally formed through elongated support means 32 of the elongated member 22, the bore 92 capable of receiving attaching means 44. Attaching means receptacle 94 receives and engages the threaded portion of the shaft 88 of anchor means 84 thereby rotatably attaching the at least one engaging means 36 to elongated member 22. Cap 96 is formed on the attaching means 44, the cap 96 being larger than the bore 92 and slightly smaller than cap receptacle 98, cap receptacle 98 being designed to receive the cap 96. Cap receptacle 98 limits the disposition of the attaching means, shown generally by the numeral 44, through the elongated member 22, and thus through the elongated support means 32, allowing the cap 96 to lie flush with the surface of the second side 42 of elongated member 22. In the Preferred Embodiment, and in FIG. 5 of the drawings, the attaching means 44 is a sleeve nut. Other attaching means known in the art may also be used and are considered to be within the spirit and scope of the present invention.

Referring now in general to FIGS. 6–12 of the drawings there will be described the utilization of the new and novel form gap filling device 20 in the construction or fabrication of a concrete building foundation. It is to be understood that the present description is given for purposes of illustration only, and it will be readily apparent to those skilled in the art that the usefulness of the present invention is not limited to this application and that changes could be made in construction and should be considered to be within the spirit and scope of the present invention.

Figure 6:
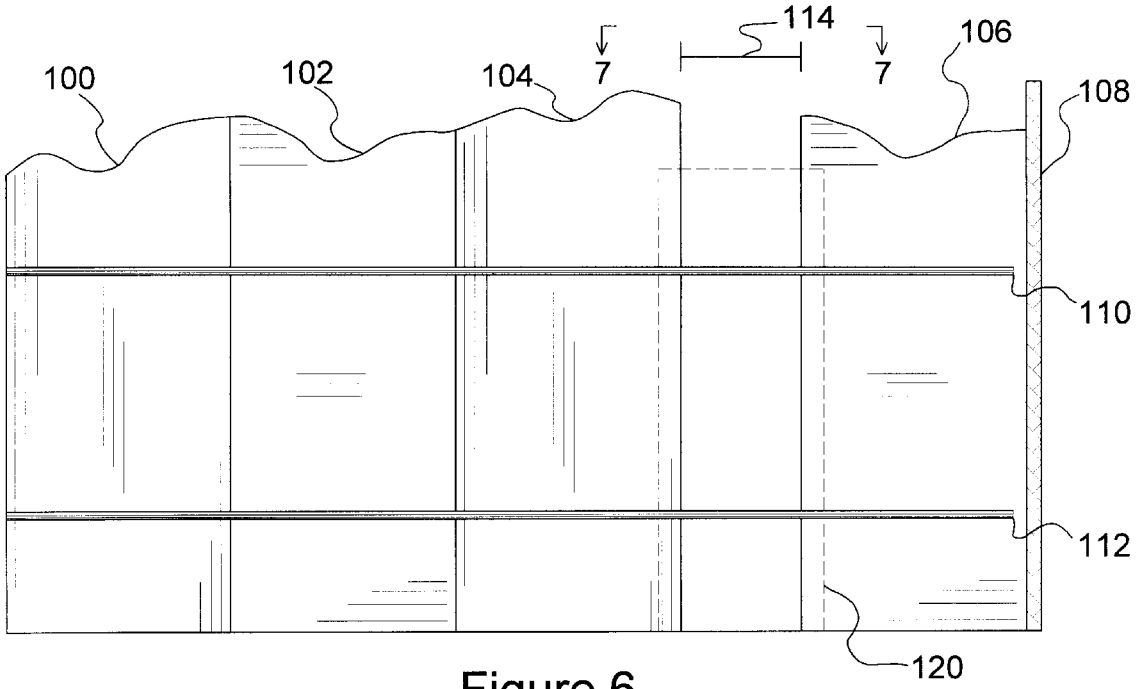
Figure 6 Prior Art
FIG. 6 is a front view of a prior art foundation form.

Referring now in particular to FIG. 6 of the drawings there is shown a prior art foundation form having a plurality of vertically arranged prior art form elements 100, 102, 104, 106 and 108. Prior art form element 108 is shown perpendicular to prior art form element 106, creating a corner of the building foundation to be constructed. Prior art support rods 110 and 112 are secured to the prior art form elements 100, 102, 104 and 106, and run the length of the foundation form to provide reinforcement to the foundation form. Form elements having dimensions suited for the particular building foundation being constructed are used to assemble the foundation form and are made of standard form material, usually panels or sheets of plywood, press board or similar material.

To construct a building foundation having a run length of 24 feet 6 inches and being 8 feet high, for example, a series of prior art form elements would be secured adjacent to and abutting one another to create a first foundation form run. A second series of adjacent and abutting form elements may be placed and secured at an angle to the first series of form elements to create a second foundation run that is generally perpendicular to and meets the first run, thereby creating a corner as illustrated by the placement of form element 108 perpendicular to form element 106 in FIG. 6. While it may be necessary for the first run and the second run to intersect at some other angle, depending on the building specifications, a second run oriented perpendicular to a first run is described herein and illustrated in FIG. 6 of the drawings for purposes of clarity.

It is generally desirous to utilize full form elements at the intersection of the first run and the second run. However, using the run length of 24 feet 6 inches given in the example above, it is readily apparent that using six standard 4 feet by 8 feet sheets of plywood, press board or similar material as form elements, which is common practice in the art, results in a six inch gap at some point in the run length. Foundation forms, and other forms, are generally constructed so that the resulting gap is near, but not at, a corner of the foundation form, or near, but not at, the end of a form run. A gap 114 is shown in FIG. 6 of the drawings to illustrate the resulting positioning of a form gap in a first run length of a foundation form between the form element 106, near the corner of the foundation form, and form element 104.

Figure 7:
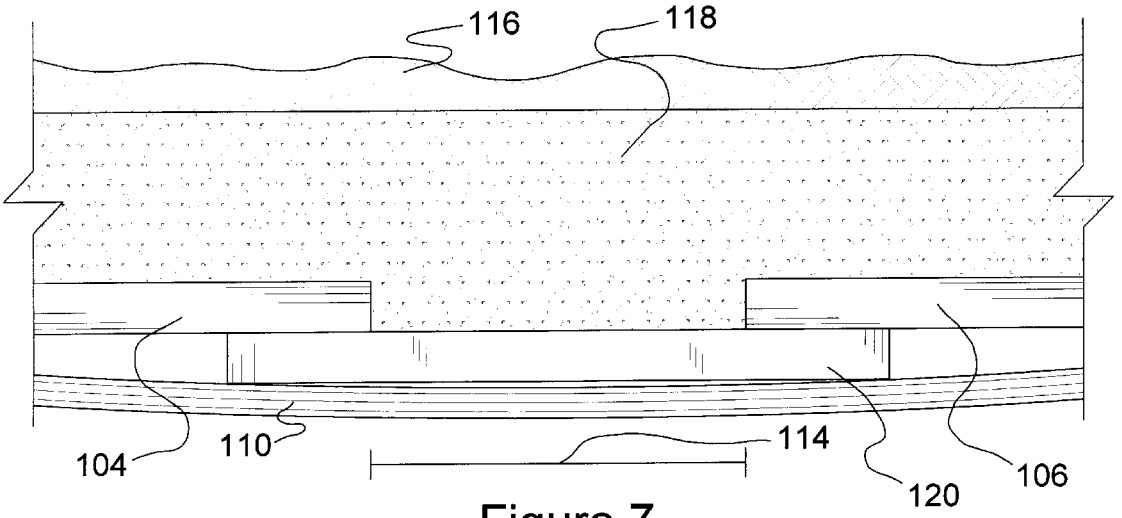
Figure 7 Prior Art
FIG. 7 is a top view of a portion of a prior art foundation form taken along lines 7—7 of FIG. 6 of the drawings.

Referring now to FIG. 7 of the drawings there is shown a top view of a portion of a prior art foundation form taken along lines 7—7 of FIG. 6 of the drawings. An earthen substrate 116 forms the back side or other form wall of the foundation form and is shown in FIG. 7 of the drawings for purposes of illustration only. Gaps in a foundation form must be filled to prevent congealable material 118, such as concrete, that is to be poured into the form, from escaping from the form.

Typical practice is to nail or otherwise secure a second piece of wood 120 to the adjacent spaced apart form elements 104 and 106 on either side of the gap 114 to close the gap 114 before pouring a congealable material 118, such as concrete. Referring briefly back to FIG. 6 of the drawings, the second piece of wood 120 is shown position over the gap 114, the second piece of wood 120 shown in dashed lines for purposes of clarity. Referring again now to FIG. 7 of the drawings, since form elements are generally sheets of plywood, press board or similar material having a thickness of one-half inch to one inch or more, the congealable material 118, such as concrete, will fill in an area corresponding to the covered gap 114 and thickness of the form elements 104 and 106. This area of congealed material will then protrude from the finished concrete wall after the form has been removed. The protruding area of hardened concrete must then be removed to create a relatively smooth foundation wall suitable for finishing, which is an expensive and hazardous process and often results in damage to other areas of the finished wall. Additionally, filling the gap 114 in this fashion bends the support rods 110 and 112 away from the adjacent spaced apart form elements 104 and 106 thereby reducing the effectiveness of the support rods 110 and 112. Support rod 112 can not be seen in FIG. 7 of the drawings, but is clearly shown in FIG. 6 of the drawings.

Figure 8:
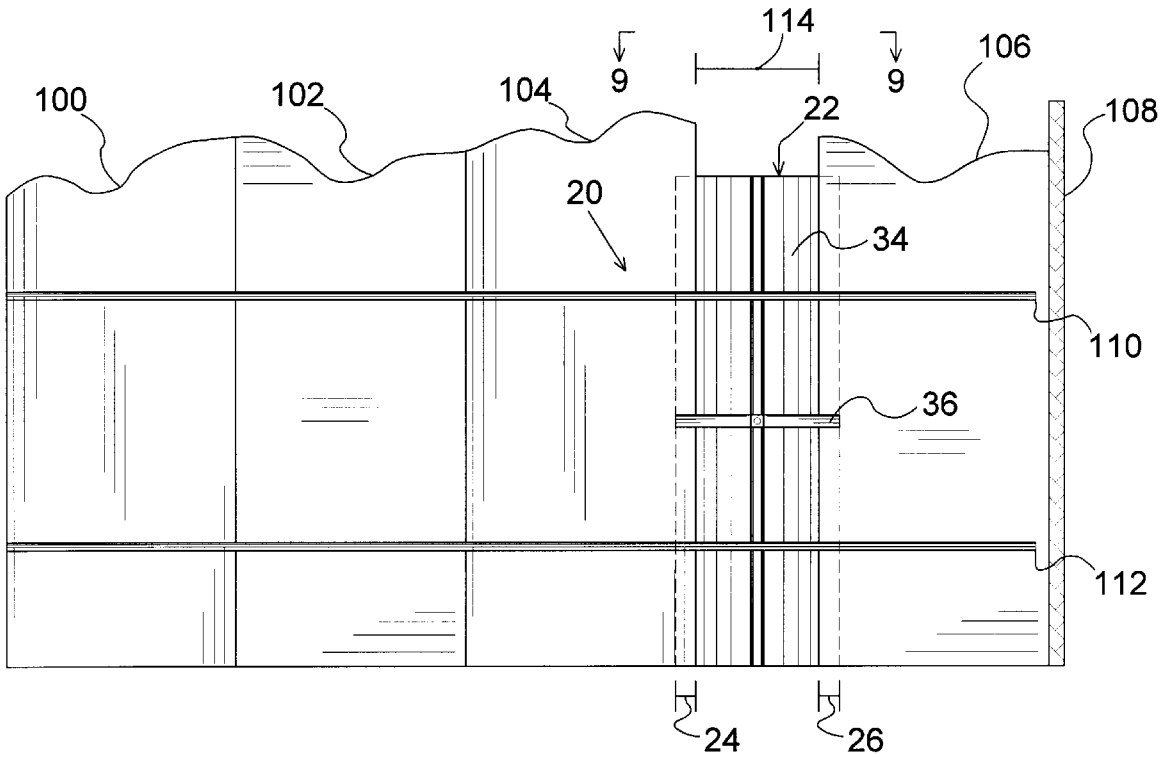
FIG. 8 is a front view of the new and novel form gap filling device positioned on a prior art foundation form.

Referring now in general to FIGS. 8–12 of the drawings, there will be described the placement and positioning of the new and novel form gap filling device, shown generally by the numeral 20, on adjacent spaced apart form elements 104 and 106 of a typical foundation form. Referring now in particular to FIG. 8 of the drawings there is shown a front view of the new and novel form gap filling device, shown generally by the numeral 20, positioned in gap 114 of a prior art foundation form consisting of a plurality of form elements 100, 102, 104, 106 and 108. Sealing portions 24 and 26 of the elongated member 22 of form gap filling device 20 are not visible in FIG. 8 and are indicated by dashed lines for purposes of clarity. Additionally, at least one spring biased rotatable engaging means 36 is shown in an engaged position in FIG. 8 of the drawings.

Figure 9:
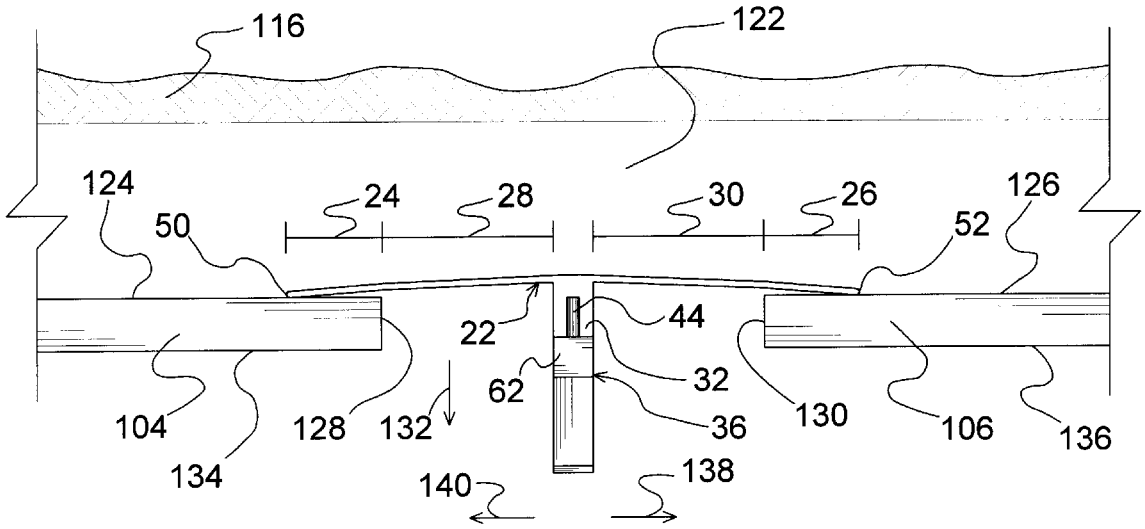
FIG. 9 is a top view of the new and novel form gap filling device in a non-engaged and non-rotated position on a prior art foundation form taken along lines 99 of FIG. 8 of the drawings.
Figure 10:
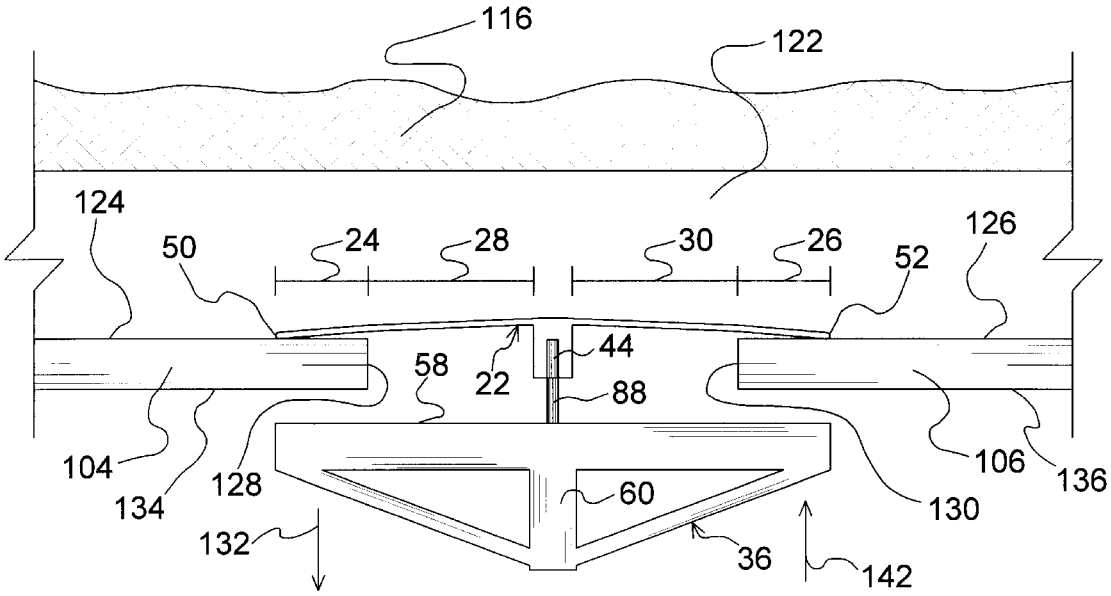
FIG. 10 is a top view of the new and novel form gap filling device in a rotated but non-engaged position on a portion of a prior art foundation form.
Figure 11:
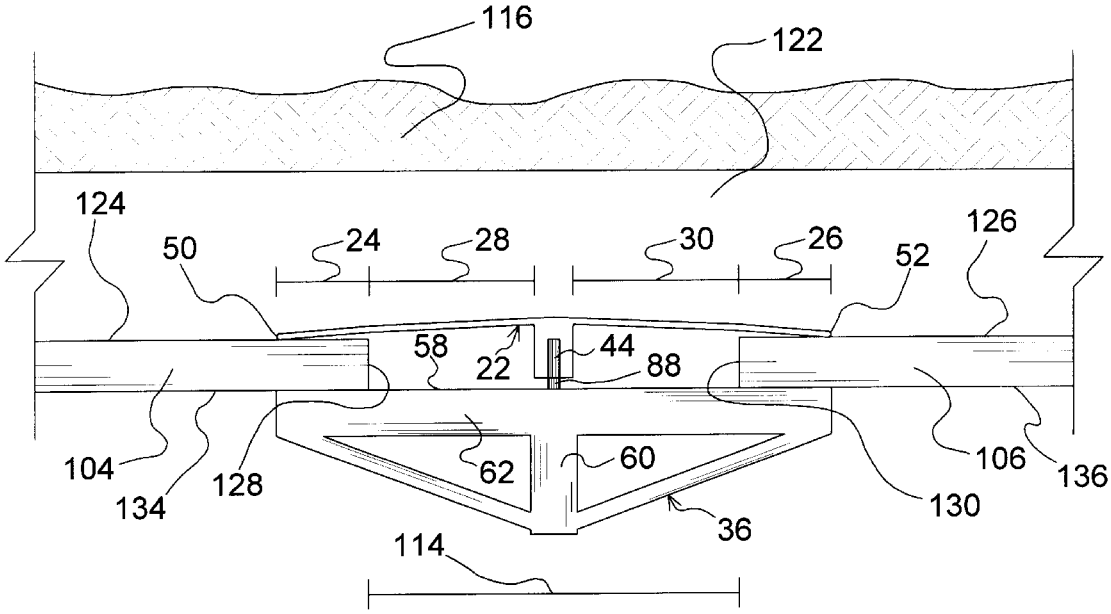
FIG. 11 is a top view of the new and novel form gap filling device in a rotated and engaged position on a portion of a prior art foundation form.

Referring now to FIG. 9 of the drawings, there is shown a top view of a portion of a prior art foundation form taken along lines 9—9 of FIG. 8 of the drawings. FIGS. 9–11 of the drawings illustrate a form foundation before congealable material is poured into the foundation form. Support rods 110 and 112 are not shown in FIGS. 9–12 of the drawings for purposes of clarity and an earthen substrate 116 acts as the other form side of the foundation form in FIGS. 9–12 of the drawings for purposes of illustration only.

Still referring to FIG. 9 of the drawings, elongated member 22 of form gap filling device 20 is positioned in a space 122, between the adjacent spaced apart form elements 104 and 106 and the earthen substrate 116. Rounded edge 50 of sealing portion 24 contacts inner surface 124 of form element 104 and rounded edge 52 of sealing portion 26 contacts inner surface 126 of form element 106. The at least one spring biased rotatable engaging means 36 is aligned with elongated support means 32. The elongated member 22 is easily inserted into space 122 by first inserting rounded edge 50, and thus sealing portion 24, into the space 122, followed by rounded edge 52, and thus sealing portion 26, or by first inserting rounded edge 52, and thus sealing portion 26, followed by rounded edge 50, and thus sealing portion 24. The rounded edges 50 and 52 are then positioned parallel relative to edges 128 and 130 of the adjacent spaced apart form elements 104 and 106, respectively. The at least one spring biased rotatable engaging means 36 is pulled in the direction of the arrow 132 so that engaging member 62 clears outer surfaces 134 and 136 of the adjacent spaced apart form elements 104 and 106, respectively, when the at least one engaging means 36 is rotated in either the direction of the arrow 138 or arrow 140.

Referring now to FIG. 10 of the drawings there is shown a top view of a portion of a prior art foundation form similar to FIG. 9 of the drawings, the at least one spring biased rotatable engaging means 36 in a rotated but non-engaged position. The at least one spring biased rotatable engaging means 36 has been rotated so that engaging member 62 is perpendicular to a longitudinal axis of the edges 128 and 130 of the adjacent spaced apart form elements 104 and 106, respectively, and so that portions of engaging surface 58 are positioned over outer surfaces 134 and 136 of the adjacent spaced apart form elements 104 and 106, respectively. As the at least one spring biased rotatable engaging means 36 is pulled in the direction of the arrow 132, the spring means 78 contained within the upstanding main body 60 of the at least one engaging means 36 is compressed, shaft 88 of the anchor means 84 is exposed and the at least one engaging means 36 is urged toward adjacent spaced apart form elements 104 and 106 in the direction of the arrow 142. The spring means 78 and portions of the anchor means 84 are not visible in FIG. 10 but are clearly shown in FIG. 5 of the drawings.

Referring now to FIG. 11 of the drawings, there is shown a top view of a portion of a prior art foundation form similar to FIG. 10 of the drawings, the at least one spring biased rotatable engaging means 36 in a rotated engaged position. After the at least one spring biased rotatable engaging means 36 has been rotated, as previously described, and then released, portions of engaging surface 58 of the engaging member 62 contact the outer surfaces 134 and 136 of the form elements 104 and 106, respectively. Spring biased pressure draws rounded edges 50 and 52 against inner surfaces 124 and 126 of the form elements 104 and 106, respectively, while simultaneously drawing engaging surface 58 against outer surfaces 134 and 136 of the adjacent spaced apart form elements 104 and 106, respectively, thereby engaging the form elements 104 and 106. Since elongated support means 32 is contained within the gap 114 between adjacent spaced apart form elements 104 and 106, any support rods that may used to reinforce the foundation form are not pushed away from the outer surfaces 134 and 136 of the adjacent spaced apart form elements 104 and 106. Further, the elongated support means 32 has been designed with support surface 56, as previously described, to contact any support rods spanning the gap 114 that may be present, thereby reinforcing the support rods, maintaining the parallel relationship of the support rods to the outer surface of the form and preventing the support rods from bending into the gap 114. Support rods are not shown in FIG. 11 of the drawings but are clearly shown in FIGS. 6, 7 and 8 of the drawings.

Figure 12:
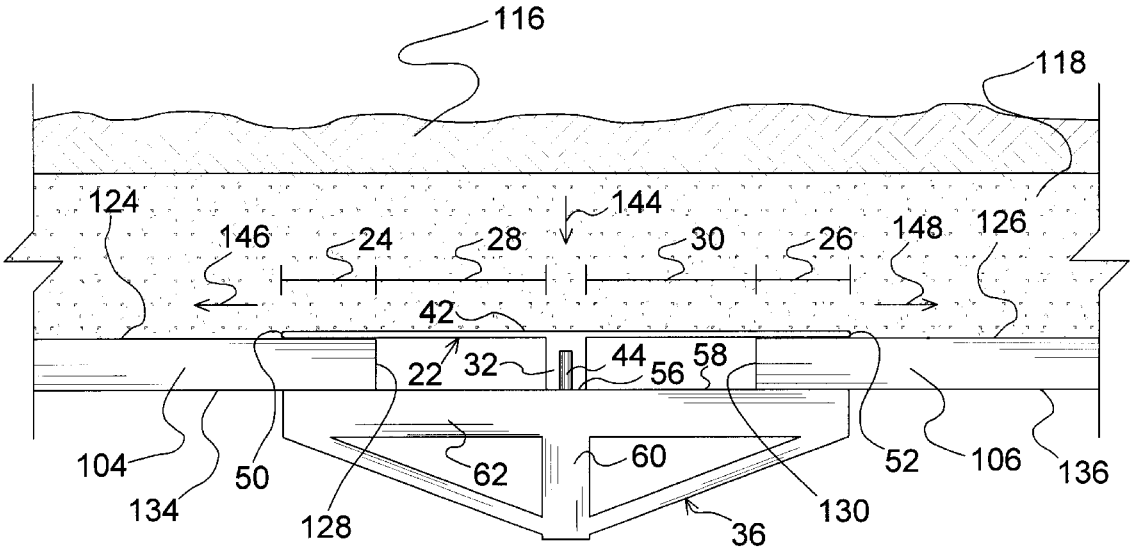
FIG. 12 is a top view the new and novel form gap filling device in a rotated, engaged and flattened position on a portion of a prior art foundation form.

Referring now to FIG. 12 of the drawings there is shown a top view of a portion of a prior art foundation form similar to FIG. 11 of the drawings, the at least one spring biased rotatable engaging means 36 in a rotated engaged position. FIG. 12 of the drawings further illustrates the state of a form foundation after congealable material 118, such as concrete, has been poured into the foundation form.

Pressure exerted by the weight of congealable material 118 in the direction of the arrow 144 causes main portions 28 and 30 and sealing portions 24 and 26 of the elongated member 22 to flatten out becoming essentially parallel with inner surfaces 124 and 126 of the form elements 104 and 106, respectively. The rounded edges 50 and 52 easily slide along inner surfaces 124 and 126 of the form elements 104 and 106 in the direction of the arrows 146 and 148, respectively, thereby allowing sealing portions 24 and 26 to fully contact inner surfaces 124 and 126 of the form elements 104 and 106, respectively. Full contact of the sealing portions 24 and 26 on the inner surfaces 124 and 126, respectively, prevents congealable material 118 from escaping the foundation form. Further, if support rods are used to reinforce the foundation form as previously discussed, contact of support rods on the support surface 56 of the elongated support means 32 maintains parallel alignment of the elongated member 22 with the inner surfaces 124 and 126 of the form elements 104 and 106, respectively.

In the Preferred Embodiment, the elongated member 22 is constructed from a semi-rigid, resilient material such as extruded aluminum. The main portions 28 and 30 and the sealing portions 24 and 26 of the elongated member 22 are further designed to be from one tenth of an inch thick to three tenths of an inch thick. Additionally, the main portions 28 and 30 and the sealing portions 24 and 26 of the elongated member 22 are designed having an inherent memory, thereby retaining their original shape and angled configuration after having been subjected to flattening forces of a congealable material 118. Other rigid, resilient materials having memory and other thicknesses may also be used and are considered to be within the spirit and scope of the present invention.

After a congealable material 118, such as concrete, has been poured into the foundation form and allowed to congeal, harden or cure, the form elements are removed. The smooth nature of the second side 42 of the elongated member 22 allows the form gap filling device 20 to be easily removed from the congealed material along with the form elements to which it is removably engaged. The form gap filling device 20 can then be quickly and easily removed from the form elements by simply pulling the at least one spring biased rotatable engaging means 36 away from the form elements and rotating the at least one engaging means 36 to a position where the form gap filling device 20 is released from the form elements. Still referring to FIG. 12 of the drawings, it can be clearly seen that after the form elements and the form gap filling device 20 have been removed from the now hardened building foundation, only a slight indentation will be left in the surface of the building foundation or wall. Additionally, since the attaching means 44 lies flush with second side 42 of the elongated member 22, thereby preserving the smooth surface of the second side 42, a smooth finished surface results in the slight indentation left by the elongated member 22 of the form gap filling device 20. The attaching means 44 can not be seen in FIG. 12 of the drawings but is clearly shown in FIG. 5 of the drawings. Referring back to FIG. 12 of the drawings, the resulting slight indentation can be easily filled in with another congealable material or can be covered by drywall, plasterboard, wood panels or other material and does not interfere with the placement of electrical, water, gas and other conduits or equipment on the foundation, wall or similar structure. Furthermore, there are no protruding areas of hardened concrete or other congealable material that must then be removed, alleviating an expensive and hazardous process that often results in damage to other areas of the finished wall.

In the Preferred Embodiment, the elongated member 22 of the form gap filling device 20 has been designed to be from one foot to twelve feet in length, various standard lengths being made available for general form construction. That is, typical form elements are 4, 8 or 10 feet in height and thus, form gap filling devices having an elongated member 22 of 4, 8 or 10 feet in length are provided. Similarly, the elongated member 22 of the form gap filling device 20 has been designed to be from two inches to 24 inches in width, various standard widths being made available for general form construction. That is, typical gaps that may result in form construction are from two inches to eighteen inches wide and thus, form gap filling devices having an elongated member 22 of two inches, 6 inches, 9 inches, 18 inches and 24 inches wide are provided. It should be noted that the engaging member 62 of the at least one spring biased rotatable engaging means 36 is designed to have a length equal to the width of the elongated member 22. Other lengths and widths may also be provided and are considered to be within the spirit and scope of the present invention.

Figure 13:
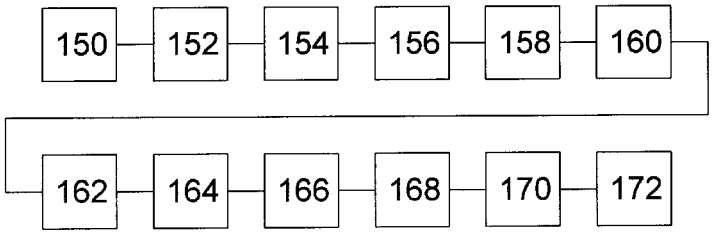
FIG. 13 is a block diagram illustrating the new and novel method.

Referring now to FIG. 13 of the drawings there will be described in detail a new and novel method by which the new and novel form gap filling device 20 is utilized. FIG. 13 is a block diagram illustrating the new and novel method.

The first step in the method, shown generally by the numeral 150, is to provide at least one form run having a plurality of form elements, the plurality of form elements being arranged so that all form elements except two are secured adjacent to and abutting one another, a gap being left between two adjacent spaced apart form elements, the arranged form elements being capable of receiving congealable material having weight and exerting force on the plurality of form elements. In the second step, shown generally by the numeral 152, at least one form gap filling device is provided, the form gap filling device having an elongated member, the elongated member having a first side, a second side and an elongated support means centrally and longitudinally formed on the first side, the elongated support means having a support surface and being of equal length as the elongated member, the elongated support means also having angled main portions oppositely formed thereon, the main portions being formed opposite the support surface, the main portions further having angled sealing portions formed thereon, the sealing portions having rounded edges, the sealing portions and the main portions further being resilient and having an inherent memory, at least one spring biased rotatable engaging means medially and rotatably attached to the elongated member and positioned on the first side of the elongated member, the at least one engaging means having a engaging member, the engaging member having an engaging surface and being medially and rotatably positioned in removable contact with the elongated support means support surface, the at least one spring biased rotatable engaging means further having a spring means centrally disposed through an upstanding main body centrally formed on the engaging member opposite the engaging surface, the spring means acting in concert with a retaining means formed on an anchor means centrally disposed through the spring means so that the spring means urges the engaging surface of the engaging member to contact a support surface of the elongated support means when the at least one spring biased rotatable engaging means is pulled away from the elongated member of the form gap filling device. In the third step, shown generally by the numeral 154, the elongated member is inserted into the form gap so that the rounded edges of the sealing portions contact an inner surface of two adjacent spaced apart form elements, one rounded edge of one sealing portion contacting the inner surface of one adjacent spaced apart form element and another rounded edge of the other sealing portion contacting the inner surface of another adjacent spaced apart form element, the at least one spring biased rotatable engaging means being positioned so that it will pass back through the form gap when the rounded edges contact the inner surface of the adjacent spaced apart form elements. In the fourth step, shown generally by the numeral 156, the at least one spring biased rotatable engaging means is pulled away from the elongated member, and thus, away from the adjacent spaced apart form elements. In the fifth step, shown generally by the numeral 158, the now extended at least one spring biased rotatable engaging means is rotated so that portions of the engaging surface of the engaging member are positioned over an outer surface of the adjacent spaced apart form elements. In the sixth step, shown generally by the numeral 160, the at least one spring biased rotatable engaging means is released, the spring means urging the engaging surface of the engaging member toward and against the outer surface of the adjacent spaced apart form elements while simultaneously urging the rounded edges of the sealing portions against the inner surface of the adjacent spaced apart form elements, thereby removably engaging the adjacent spaced apart form elements and filling the form gap. In the seventh step, shown generally by the numeral 162, congealable material is poured into the at least one form, the weight of the congealable material exerting force causing the main portions and the sealing portions of the elongated member to flatten out thereby becoming essentially parallel with the inner surfaces of the adjacent spaced apart form elements, the sealing portions fully contacting the inner surfaces of the adjacent spaced apart form elements and effectively sealing the form gap and preventing loss of congealable material from the form, the congealable material being allowed to congeal, harden, set or cure. In the eighth step, shown generally by the numeral 164, the plurality of form elements are removed from the now hardened, set or cured congealable material, the form gap filling device being removed along with the form elements from the now congealed material. In the ninth step, shown generally by the numeral 166, the at least one spring biased rotatable engaging means is pulled away from the outer surface of the now removed adjacent spaced apart form elements, and thus, away from the elongated member of the form gap filling device. In the tenth step, shown generally by the numeral 168, the now extended at least one spring biased rotatable engaging means is rotated so the engaging surface of the engaging member is positioned over the first side of the elongated member and away from the outer surface of the adjacent spaced apart form elements. In the eleventh step, shown generally by the numeral 170, the at least one spring biased rotatable engaging means is released, the spring means urging the engaging surface of the engaging member toward and against the support surface of the elongated support means. And finally, in the last step, shown generally by the numeral 172, the sealing portions of the elongated member are removed from the adjacent spaced apart form elements, the main portions and the sealing portions returning to an original shape and angled configuration so that the form gap filling device may be re-used.

From the above it can be seen that the new and novel form gap filling device and method of use accomplishes all of the objects and advantages presented herein before. Nevertheless it is within the spirit and scope of the invention that changes in the basic form gap filling device and method may be made and the Preferred Embodiment and the modifications shown and described herein have only been given by way of illustration.

Having described my invention, We claim:

1. A form gap filling device for filling or blocking form gaps in construction forms used to fabricate foundations, walls and similar structures, the foundations, walls and similar structures being fabricated from congealable material having weight and exerting force on construction forms, the construction forms having adjacent form elements, the form gap filling device preventing congealable material from escaping from form gaps between adjacent spaced apart form elements, the form gap filling device comprising:

a. an elongated member having an end, an opposite end, a center and a first side, the elongated member further having an elongated support means centrally and longitudinally formed on the first side, the elongated support means having a support surface;

b. main portions formed on the elongated support means opposite the support surface, the main portions extending the length of the elongated member and extending outward from the elongated support means, the main portions angled toward the support surface of the elongated support means;

c. sealing portions formed on the main portions, the sealing portions extending the length of the elongated member and extending outward from the main portions, the sealing portions angled toward the support surface of the elongated support means; and d. at least one spring biased rotatable engaging means rotatably attached to the first side of the elongated member, the at least one spring biased rotatable engaging means being medially positioned on and removably contacting the support surface of the elongated support means, wherein the at least one spring biased rotatable engaging means acts in concert with the sealing portions to removably engage adjacent spaced apart form elements.

2. The form gap filling device as defined in claim 1 wherein the elongated member is formed from semi-rigid, resilient material.

3. The form gap filling device as defined in claim 2 wherein the semi-rigid, resilient material is extruded aluminum.

4. The form gap filling device as defined in claim 1 wherein the main portions and the sealing portions further have an inherent memory, thereby retaining their original shape and angled configuration when the flattening forces of a congealable material are relieved.

5. The form gap filling device as defined in claim 1 wherein two at least one spring biased rotatable engaging means are medially positioned on and removably contact the support surface of the elongated support means, one of the two at least one spring biased rotatable engaging means being centrally and medially positioned equidistant between the center of the elongated member and the end of the elongated member, another of the two at least one spring biased rotatable engaging means being centrally and medially positioned equidistant between the center of the elongated member and the opposite end of the elongated member.

6. The form gap filling device as defined in claim 1 wherein three at least one spring biased rotatable engaging means are medially positioned on and removably contact the support surface of the elongated support means, a first at least one spring biased rotatable engaging means being centrally and medially positioned equidistant between the end of the elongated member and the opposite end of the elongated member, a second at least one spring biased rotatable engaging means being centrally and medially positioned equidistant between the center of the elongated member and the end of the elongated member, a third at least one spring biased rotatable engaging means being centrally and medially positioned equidistant between the center of the elongated member and the opposite end of the elongated member.

7. The form gap filling device as defined in claim 1 wherein the at least one spring biased rotatable engaging means is constructed from a rigid, non-flexing material.

8. The form gap filling device as defined in claim 1 wherein the at least one spring biased rotatable engaging means comprises an upstanding main body centrally attached to an engaging member, the engaging member having an engaging surface and ends, support members joining the ends of the engaging member with an upper portion of the upstanding main body.

9. The form gap filling device as defined in claim 8 wherein a spring means is disposed through the upstanding main body of the at least one spring biased rotatable engaging means, the spring means encompassing an anchor means disposed through the spring means, a retaining means being formed on an end of the anchor means, the retaining means and the engaging member containing the spring means within the upstanding main body, the spring means urging the at least one spring biased rotatable engaging means toward the first side of the elongated member when the at least one spring biased rotatable engaging means is in an extended position.

10. A form gap filling device for filling or blocking form gaps in construction forms used to fabricate foundations, walls and similar structures, the foundations, walls and similar structures being fabricated from congealable material having weight and exerting force on construction forms, the construction forms having adjacent form elements, the form gap filling device preventing congealable material from escaping from form gaps between adjacent spaced apart form elements, the form gap filling device comprising:

a. an elongated member having an end, an opposite end, a first side and a second side, the elongated member further having an elongated support means centrally and longitudinally formed on the first side, the elongated support means having a support surface and being of equal length as the elongated member;

b. main portions oppositely formed on the elongated support means, the main portions being formed on the elongated support means opposite the support surface, the main portions extending the length of the elongated member and extending outward from the elongated support means, wherein the main portions are angled toward the support surface of the elongated support means;

c. sealing portions formed on the main portions and extending outward from the main portions, the sealing portions being formed on the main portions away from the elongated support means and extending the length of the elongated member, wherein the sealing portions are angled toward the support surface of the elongated support means; and d. at least one spring biased rotatable engaging means rotatably attached to the first side of the elongated member, an anchor means centrally disposed through the at least one spring biased rotatable engaging means, the anchor means having a threaded portion which is engaged by an attaching means disposed through the elongated member and through the elongated support means of the elongated member, thereby rotatably anchoring the at least one spring biased rotatable engaging means to the elongated member, wherein the at least one spring biased rotatable engaging means is medially positioned on and removably contacts the support surface of the elongated support means, the at least one spring biased rotatable engaging means acting in concert with the sealing portions to removably engage spaced apart form elements.

11. The form gap filling device as defined in claim 10 wherein the elongated member is formed from semi-rigid, resilient material.

12. The form gap filling device as defined in claim 11 wherein the semi-rigid, resilient material is extruded aluminum.

13. The form gap filling device as defined in claim 10 wherein the main portions and the sealing portions further have an inherent memory thereby retaining their original shape and angled configuration when the flattening forces of a congealable material are relieved.

14. The form gap filling device as defined in claim 10 wherein two at least one spring biased rotatable engaging means are medially positioned on and removably contact the support surface of the elongated support means, one of the two at least one spring biased rotatable engaging means being centrally and medially positioned equidistant between the center of the elongated member and the end of the elongated member, another of the two at least one spring biased rotatable engaging means being centrally and medially positioned equidistant between the center of the elongated member and the opposite end of the elongated member.

15. The form gap filling device as defined in claim 10 wherein three at least one spring biased rotatable engaging means are medially positioned on and removably contact the support surface of the elongated support means, a first at least one spring biased rotatable engaging means being centrally and medially positioned equidistant between the end of the elongated member and the opposite end of the elongated member, a second at least one spring biased rotatable engaging means being centrally and medially positioned equidistant between the center of the elongated member and the end of the elongated member, a third at least one spring biased rotatable engaging means being centrally and medially positioned equidistant between the center of the elongated member and the opposite end of the elongated member.

16. The form gap filling device as defined in claim 10 wherein the at least one spring biased rotatable engaging means is constructed from a rigid, non-flexing material.

17. The form gap filling device as defined in claim 10 wherein the at least one spring biased rotatable engaging means comprises an upstanding main body centrally attached to an engaging member, the engaging member having an engaging surface and ends, support members joining the ends of the engaging member with an upper portion of the upstanding main body.

18. The form gap filling device as defined in claim 17 wherein a spring means is disposed through the upstanding main body of the at least one spring biased rotatable engaging means, the spring means encompassing an anchor means disposed through the spring means, a retaining means being formed on an end of the anchor means, the retaining means and the engaging member containing the spring means within the upstanding main body, the spring means urging the at least one spring biased rotatable engaging means toward the first side of the elongated member when the at least one spring biased rotatable engaging means is in an extended position.

* * * * *